United States Patent [19]

Kato et al.

[11] Patent Number: 4,804,341

[45] Date of Patent: Feb. 14, 1989

[54] ELECTRICAL CONNECTOR

[75] Inventors: Shinichi Kato, Fujisawa; Shigemitsu Inaba, Gotemba, both of Japan

[73] Assignees: Nissan Motor Co., Ltd.; Yazaki Corporation, both of Japan

[21] Appl. No.: 14,373

[22] Filed: Feb. 10, 1987

[30] Foreign Application Priority Data

Feb. 14, 1986 [JP] Japan ..... 61-29074

[51] Int. Cl.[4] ..... H01R 13/436

[52] U.S. Cl. ..... 439/733; 439/869

[58] Field of Search ..... 439/733, 744–749, 439/752, 869

[56] References Cited

U.S. PATENT DOCUMENTS

| | | | |
|---|---|---|---|
| 1,149,599 | 8/1915 | Small | 439/679 |
| 3,487,355 | 12/1969 | Cairns | 439/733 |
| 4,124,264 | 11/1978 | Kato et al. | 439/595 |
| 4,319,799 | 3/1982 | Pearce, Jr. | 439/752 |
| 4,557,542 | 12/1985 | Coller et al. | 439/595 |
| 4,684,190 | 8/1987 | Clark et al. | 439/733 |

FOREIGN PATENT DOCUMENTS

| | | | |
|---|---|---|---|
| 60-876 | 1/1985 | Japan . | |
| 1491217 | 11/1977 | United Kingdom | 439/733 |
| 2081526 | 9/1984 | United Kingdom . | |

*Primary Examiner*—Gil Weidenfeld
*Assistant Examiner*—Gary F. Paumen
*Attorney, Agent, or Firm*—Lowe, Price, LeBlanc, Becker & Shur

[57] ABSTRACT

A connector housing is formed with two kinds of terminal passages for receiving therein two kinds of terminals each of which has an electrical contact portion, a conductive lead connecting portion and a transition portion between the electrical contact portion and the conductive lead connecting portion. The connector housing is also formed with a plurality of retainer passages for receiving therein retainer pins. The retainer passages are arranged so that each retainer passage passes through the intermediate portions of the terminal passages of each row and allow each retainer pins to engage the transition portions of the terminals of each row.

6 Claims, 3 Drawing Sheets

FIG. 3
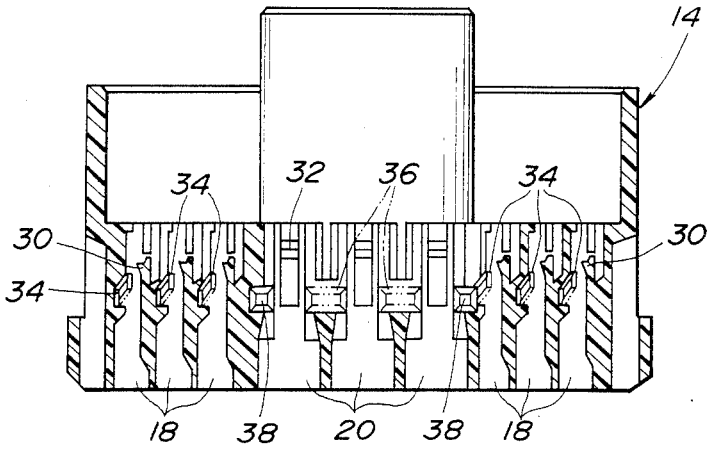
FIG. 4A
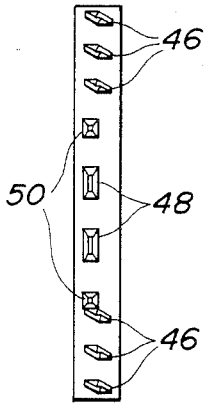
FIG. 4B
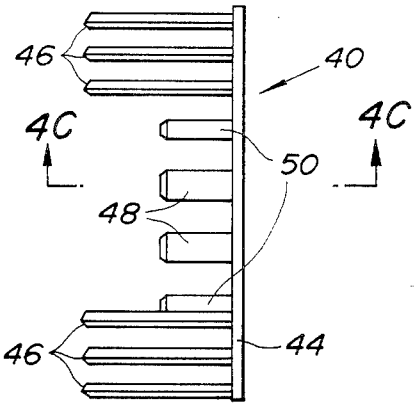
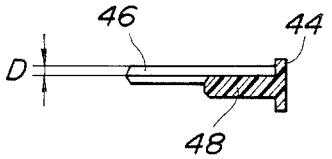
FIG. 4C

ELECTRICAL CONNECTOR

BACKGROUND OF THE INVENTION

1. Field of the Invention

The present invention relates in general to a multi-way electrical connector having at least two kinds of terminals and more particularly to a retaining mechanism for retaining each terminal in position in addition to its latching means.

2. Description of the Prior Art

A multi-way electrical connector of the above described kind is disclosed in Japanese Provisional Utility Model Publication No. 60-876. In the prior art electrical connector, plural retaining pins are adapted to respectively engage end portions of corresponding terminals arranged in a row to which conductive leads are secured by pressing. The prior art electrical connector is disadvantageous in that the retaining pins cannot be inserted with ease but are liable to be cut by the end portions of the terminals or prevented by same from being inserted into position. This is because the end portions of the terminals, which are adapted to clamp the conductive leads by pressing, cannot be uniform in shape but tend to vary from terminal to terminal.

SUMMARY OF THE INVENTION

In accordance with the present invention, there is provided a connector part for a multi-way electrical connector which comprises a connector housing having two kinds of parallel terminal passages, the terminal passages being arranged in a plurality of parallel rows extending at right angles to the terminal passages in such a manner that each row includes the same kind of terminal passages, two kinds of terminals received in the corresponding kinds of terminal passages, respectively and each having an electrical contact portion, a connecting potion for connection with a conductive lead and a transition portion between the electrical contact portion and the conductive lead connecting portion, each of the terminal passages having an intermediate portion between the opposite ends thereof for receiving the transition portion of the terminal, the housing being formed with a plurality of retainer passages extending at right angles to the terminal passages, the retainer passages being arranged in parallel rows and in such a manner that each retainer passage passes through the intermediate portions of the terminal passages of each row, and a retainer having a plurality of retainer pins inserted into the retainer passages and engaged with the transition portions of terminals in such a manner as to prevent movement of the terminals in the rearward, withdrawal direction.

The above structure is quite effective for overcoming the above noted disadvantage inherent in the prior art electrical connector.

It is accordingly an object of the present invention to provide a novel and improved multi-way electrical connector which makes it possible for retainer pins to be inserted into position easily and smoothly when terminals are correctly installed.

It is a further object of the present invention to provide a novel and improved multi-way electrical connector of the above described character which can assuredly prevent incomplete or incorrect insertion of terminals.

It is a still further object of the present invention to provide a novel and improved multi-way electrical connector of the above described character which makes it possible for a plurality of retainer pins to be inserted into position at the same time and thereby reduce the cost of assembler.

It is a yet further object of the present invention to provide a novel and improved multi-way electrical connector of the above described character which is suited for adoption to the kind having two or more than two kinds of terminals.

BRIEF DESCRIPTION OF THE DRAWINGS

FIG. 3 is a longitudinal sectional view of a retainer employed in the socket part of FIG. 1;

FIG. 4A is an elevational view of a retainer employed in the socket part of FIG. 1;

FIG. 4B is a side view of the retainer of FIG. 4A;

FIG. 4C is a sectional view taken along the line 4C—4C of FIG. 4B.

DETAILED DESCRIPTION OF THE PREFERRED EMBODIMENT

Figure 1:
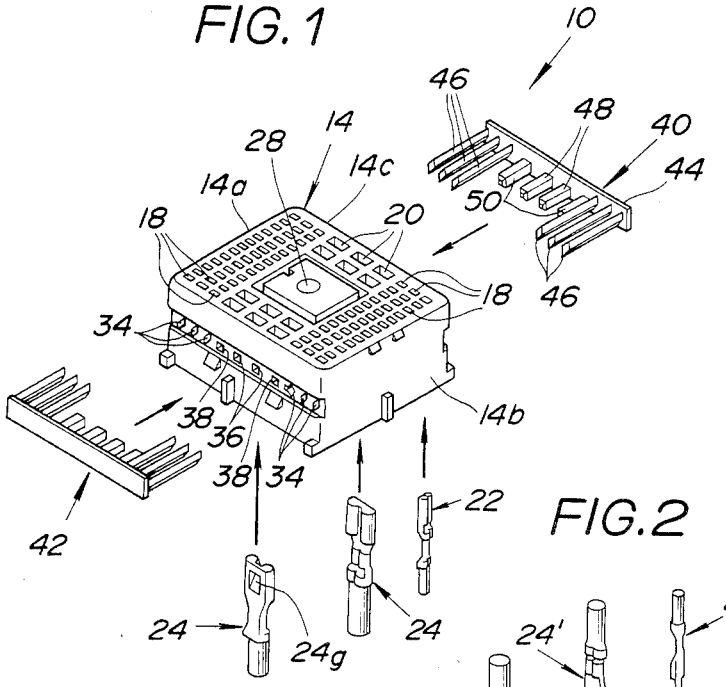
FIGS. 1 and 2 are exploded views respectively showing a socket part and a plug part of a multi-way electrical connector according to an embodiment of the present invention.
Figure 2:
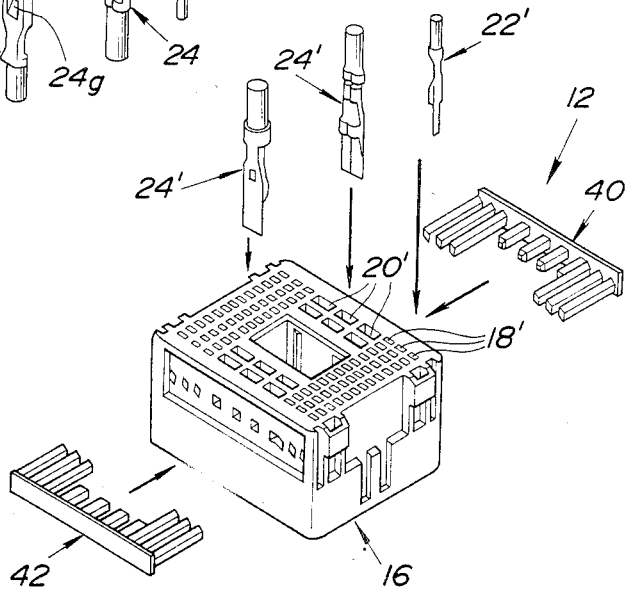
Figure 5:
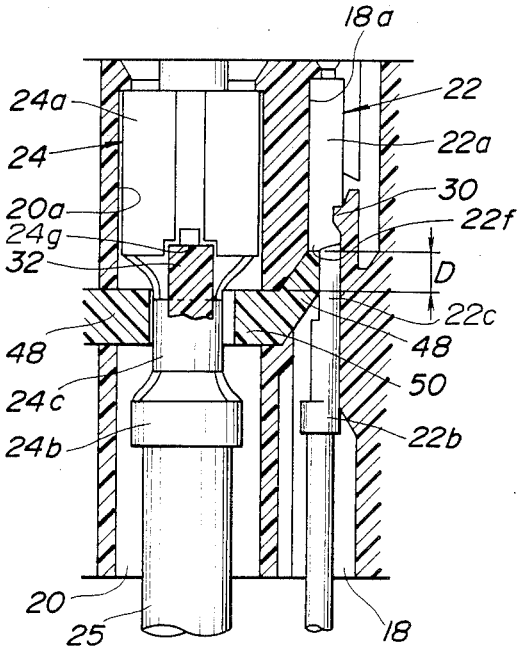
FIGS. 5 and 6A–6B are enlarged, fragmentary sectional views of the socket part of FIG. 1 and showing the operative state of the retainer.
Figure 6A:
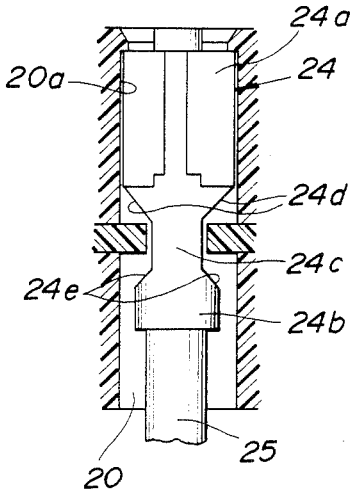
Figure 6B:
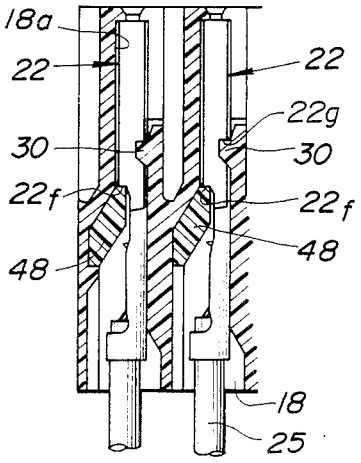

Referring to FIGS. 1 and 2, an electrical connector includes of a socket part 10 and a plug part 12. The socket part 10 includes a rectangular socket connector housing 14 made of an insulating material, while the plug part 12 includes a rectangular plug connector housing 16 made of insulating material. Each connector housing 14 or 16 is formed with two kinds of parallel terminal passages 18, 20 or 18', 20' which include a plurality of parallel terminal passages within which a corresponding number of female terminals 22 and 24 or a corresponding number of male terminals 22' and 24' are received. In use, the socket part 10 will be mated with the plug part 12 by means of a bolt, (not shown) and a nut 28. Since the retaining mechanisms for the socket part 10 and the plug part 12 according to the present invention are substantially the same, explanation will hereinafter be made mainly to the socket part 10.

The two kinds of terminals 22 and 24 are different in shape and size, i.e., one kind 22 is smaller in width than the other kind 24. Each terminal 22 or 24 is shaped to have a flatly configured, socket-shaped electrical contact portion **22*a* or 24*a* for connection with a plug-shaped electrical contact portion 22'*a* or 24'*a* of the terminal 22' or 24', a connecting portion 22*b* or 24*b* for connection with a conductive lead 25 and a thinned-and-narrowed transition portion 22*c* or 24*c* between the electrical contact portion 22*a* or 24*a* and the conductive lead connecting portion 22*b* or 24*b*. The transition portion 24*c* of the terminal 24 is shaped to provide four shoulders 24*d*, 24*e*, two 24*d* of which are located at one end of the transition portion 24*c* next to the electrical connector portion 24*a*. The remaining two shoulders 24*e* are located at the other end of the transition portion 24*c* next to the conductive lead connecting portion 24*b*. The transition portion 22*c* of the terminal 22 cooperates with the electrical contact portion 22*a* to have, at the end next to the electrical contact portion 22*a*, a shoulder 22*f* which is located on one of the sides of the terminal 22** opposing in the thickness direction of the electrical contact portion 22*a*. The terminal 22 is further provided with a window or depression 22*g* adjacent the shoulder 22*f* and on the side opposite to the side where the shoulder 22*f* is provided. In like manner, the terminal 24 is formed with a window or depression 24*g*. The windows or depressions 22*g* and 24*g* are adapted to constitute part of a latching means as will be described hereinafter.

Of the two kinds of terminal passages 18 and 20, the terminal passages 18 for the terminals 22 are arranged in six parallel rows extending at right angles to the terminal passages 18 and parallel to a pair of opposite sides 14*a* and 14*b* of the connector housing 14. Of the six rows of terminal passages 18, three are arranged adjacent one 14*a* of the opposite sides of the connector housing 14 and the remaining three are arranged adjacent the other side 14*b* so that the nut 28 is located between the two groups of terminal passages 18 respectively arranged in three rows. The terminal passages 20 for the terminals 24 are arranged in three parallel rows between the above two groups of terminal passages 18. The three rows of terminal passages 20 are adapted to extend at right angles to the terminal passages 20 and parallel to the opposite sides 14*a* and 14*b* of the connector housing 14 though each rows are separated by the nut 28 into two sections positioned on the opposite sides of the nut 28.

Each terminal passage 18 has a passage portion 18*a* for receiving therein the electrical contact portion 22*a*. In like manner, each terminal passages 20 has a passage portion 20*a* for receiving therein the electrical contact portion 24*a*. The passage portions 18*a* and 20*a* are arranged so that the above described opposite sides of the terminals 24 which are provided with the four shoulders 24*d* and 24*e* are directed toward the sides 14*a* and 14*b* of the connector housing 14, respectively while the side of the terminal 22 which is provided with the shoulder 22*f* is directed toward the side 14*a* of the connector housing 14.

As shown in FIG. 3, each terminal passage 18 is provided with flexible latching arms 30. In like manner, each terminal passage 20 is provided with flexible latching arms 32. The latching arms 30 and 32 are respectively engageable with the windows 22*g* and 24*g* of the terminals 22 and 24 so as to prevent movement of the terminals 22 and 24 in the rearward, withdrawal direction.

The connector housing 14 is formed with a plurality of parallel retainer passages 34, 36 and 38 extending at right angles to the terminal passages 18 and 20 and parallel to the rows of the terminal passages 18 and 20, i.e., parallel to the opposite sides 14*a* and 14*b* of the connector housing 14 or at right angles to the opposite sides 14*c* and 14*d* of the connector housing 14. The retainer passages 34, 36 and 38 are arranged to pass through the central portions of the corresponding terminal passages 18 and 20 in row within which the transition portions 22*c* and 24*c* of the terminals 22 and 24 are received when the terminals 22 and 24 are inserted into position.

The socket part 10 is provided with two retainers 40 and 42 each of which includes an elongated base plate 44 and a plurality of parallel retainer pins 46, 48 and 50 secured to the base plate 44 and projecting therefrom to form a single unit having a comblike configuration. The retainer pins 46, 48 and 50 are insertable into the retainer passages 34, 36 and 38 and engageable with the transition portions 22*c* and 24*c* of the terminals 22 and 24 to retain the terminals 22 and 24 in position in addition to the latching means constituted by the windows 22*g*, 24*g* and the latching arms 30 and 32.

More specifically, each retainer 40 and 42 includes three kinds of retainer pins 46, 48 and 50 which are ten in total, i.e., six retainer pins 46 of the first kind, two retainer pins 48 of the second kind and two retainer pins 50 of the third kind. Of the six retainer pins 46 of the first kind, three are secured to one longitudinal end portion of the base plate 44 while the remaining three are secured to the other longitudinal end portion. The two retainer pins 48 of the second kind are secured to the longitudinally central portion of the base plate 44, and the two retainer pins 50 of the third kind are secured to the base plate 44 so as to be positioned on the outer sides of the second kind of retainer pins 48 and between the above two groups of retainer pins 46 of the first kind. The retainer pins 50 of the third kind are half as wide as the retainer pins 48 of the second kind, and one of the retainer pins 50 of the third kind is so located as to be joined with the adjacent one of the retainer pins 46 of the first kind to form an integral configuration. The retainer pins 46 of the first kind have a rhombus-like cross section, while the second kind of retainer pins 48 have a rectangular cross section. The retainer pins 50 of the third kind have a square or nearly square cross section. As seen from FIG. 4C, a gap "D" is provided between an imaginary plane on which the first kind of retaining pins 46 are placed and an imaginary plane on which the retaining pins 48 and 50 of the second and third kinds are placed. The retainer pins 46, 48 and 50 are of such length that one of the retainers 40 or 42 retains half of the terminals 22 and 24 of each rows and the other retainer 42 or 40 retains the remaining half of the terminals 22 and 24 of each rows.

The retainer passages 34, 36 and 38 have cross sections corresponding to those of the retainer pins 46, 48 and 50, respectively, i.e., the connector housing 14 is formed with three kinds of retainer passages 34, 36 and 38 corresponding to the three kinds of retainer pins 46, 48 and 50, respectively. In this connection, one of the retainer passages 36 of the second kind is joined with the adjacent one of the retainer passages 34 of the first kind to communicate with each other in their transversal directions.

With the foregoing structure, when the terminals 22 and 24 are inserted into the terminal passages 18 and 20 of the connector housing 14 and put into position, the latching arms 30 and 32 are engaged in the windows 22*g* and 24*g* to latch the terminals 22 and 24. Under this circumstance, when the retainers 40 and 42 are installed in place, allowing the retainer pins 46, 48 and 50 to be inserted into position within the terminal passages 34, 36 and 38, the retainer pins 46 of the first kind are engaged with the shoulders 22*f* of the terminals 22 so as to prevent movement of the terminals 22 in the rearward, withdrawal direction, while the retainer pins 48 of the second kind are positioned between the shoulders 24*d* and 24*e* of the terminals 24 so as to be engageable with the terminals 24 and thereby prevent movement of the terminals 24 in the rearward, withdrawal direction. In this connection, each retainer pin 48 is adapted to engage, at the opposite lateral ends thereof, the terminals 24 of the adjacent two rows, i.e., the two retainer pins 48 of the second kind are engageable with the terminals 24 of all the three rows. The retainer pins 50 of the third kind are respectively engageable with the terminals 24 of the outer two of the three rows, and each retainer pin 50 has one lateral side positioned between the shoulders 24*d* and 24*e* of the terminals 24 so as to prevent movement of the terminals 24 in the rearward, withdrawal direction.

From the foregoing, it is to be understood that the retainers 40 and 42 can be inserted into position easily and smoothly for retaining two kinds of terminals 40 and 42 in position in addition to their latching means since the retaining pins 22 and 24 are adapted to engage the transition portions 22*c* and 24*c* of the terminals 22 and 24, i.e., the intermediate portion between electrical contact portions 22*a* and 24*a* and the conductive lead connecting portions 22*b* and 24*b*, which intermediate portions are scarcely affected by the pressing processing for attaching the conductive leads 25 to the conductive leads connecting portions 22*b* and 24*b*.

It is further to be understood that the above structure is similarly applicable to the male part 12 of the electrical connector to produce the same effects.

It is still further to be understood that the present invention can be applicable to a multi-way electrical connector having three or more than three kinds of terminals though it has been described and shown as to the type having two kinds of terminals.

It is still further to be understood that the engagement area between the terminal and the retaining pin can be wider as compared with the prior art electrical connector in which each retainer pin is adapted to engage the ends of conductive lead connecting portions of terminals, whereby the terminals can be retained by the retainers more assuredly and reliably.

It is yet further to be understood that the retainer pins 46, 48 and 50 are assuredly prevented from insertion into the retainer passages 34, 36 and 38 when any one of the terminals 22 and 24 is incompletely or incorrectly inserted. In this connection, the prior art electrical connector described hereinbefore has the possibility that a retainer pin is inserted into position even when a terminal is in an incompletely inserted state since the retainer pin can be engaged with a narrowed central portion of the terminal to pass therethrough.

It is yet further to be understood that the electrical connector of the present invention is suited for adoption to the kind having two or more than two kinds of terminals and can reduce the assembling expense since the retainer pins are joined together by the base plate so as to be inserted into position at the same time.

What is claimed is:

1. A connector part for a multi-way electrical connector comprising:

a connector housing having at least two kinds of substantially parallel terminal passages, said terminal passages being arranged in a plurality of generally parallel rows such that substantially each row includes the same kind of terminal passages;

at least two kinds of terminals received in the corresponding two kinds of terminal passages, respectively, and each terminal having an electrical contact portion, a connecting portion for connection with a conductive lead and a transition portion between said electrical contact portion and said conductive lead connecting portion;

each of said terminal passages having an intermediate portion between the opposite ends thereof for receiving said transition portion of said terminal;

said terminals being respectively formed with windows and said terminal passages being provided with latching arms engaged in said windows to latch said terminals when said terminals are inserted into position;

said at least two kinds of terminals being arranged so that the electrical contact portion of substantially each terminal of one kind and the electrical contact portion of substantially each terminal of the other kind, when extended in their respective width directions by imaginary planes respectively coplanar with said electrical contact portions, intersect at substantially right angles to each other;

said housing being formed with a plurality of retainer passages extending at substantially right angles to said terminal passages, said retainer passages being arranged in generally parallel rows and in such a manner that each retainer passage passes through the intermediate portions of said terminal passages of each row; and a retainer having a plurality of retainer pins inserted into said retainer passages and engaged with said transition portions of said terminals in such a manner as to prevent movement of said terminals in a rearward, withdrawal direction.

2. A connector part as set forth in claim 1 wherein said retainer comprises an elongated base plate to which said retainer pins are secured and project therefrom to form a single unit having a comblike configuration.

3. A connector part as set forth in claim 1, further comprising a second retainer so that said first mentioned retainer retains half of said terminals of each of said rows and the second mentions retainer retains the remaining half of said terminals of each of said rows.

4. A connector part as set forth in claim 3 wherein each terminal of one kind has a shoulder at said transition portion, said shoulder being located on one of the sides of each terminal for engagement with a corresponding one of said retaining pins.

5. A connector part as set forth in claim 4 wherein each terminal of the other kind has four shoulders, two of which are located at one end of the transition portion next to said electrical contact portion and on the respective sides of said electrical contact portion and the remaining two of which are located at the other end of said transition portion next to said conductive lead connecting portion and on the respective sides of said electrical contact portion, said four shoulders of each terminal of the other kind being provided for engagement with two of said retainer pins.

6. A connector part as set forth in claim 5 wherein one of said retainer pins is rectangular in cross section and has opposite lateral ends respectively engaged with two of said shoulders of two of said other kind of terminals of two adjacent said rows.

* * * * *